US005899331A

United States Patent [19]

Warren, Jr.

[11] Patent Number: 5,899,331

[45] Date of Patent: May 4, 1999

[54] MOLDED ROLL SUPPORT AND SPACING MEMBER HAVING REINFORCING BRIDGES

[75] Inventor: Robb A. Warren, Jr., Appleton, Wis.

[73] Assignee: Great Northern Corporation, Appleton, Wis.

[21] Appl. No.: 08/970,061

[22] Filed: Nov. 13, 1997

[51] Int. Cl.[6] ..... B65D 85/66

[52] U.S. Cl. ..... 206/443; 206/391; 206/389

[58] Field of Search ..... 206/391, 394, 206/443, 593, 389, 523, 589, 497, 598, 590; 285/22; 220/4.24, 4.2, 4.21

[56] References Cited

U.S. PATENT DOCUMENTS

| | | | |
|---|---|---|---|
| D. 381,180 | 7/1997 | Schueneman et al. | D34/38 |
| 2,838,173 | 6/1958 | Emery | 206/65 |
| 2,990,951 | 7/1961 | Fallert | 206/65 |
| 3,708,084 | 7/1983 | Bixler et al. | 217/26.5 |
| 4,195,732 | 4/1980 | Bell | 206/391 |
| 4,385,091 | 5/1983 | Roellchen | 428/134 |
| 4,435,463 | 3/1984 | Roellchen | 428/158 |
| 4,832,196 | 5/1989 | Butler | 206/391 |
| 4,901,870 | 2/1990 | Wright et al. | 211/59.4 |
| 5,080,314 | 1/1992 | Moyer et al. | 206/391 |
| 5,555,671 | 8/1996 | Voight et al. | 206/523 |

FOREIGN PATENT DOCUMENTS

| | | | |
|---|---|---|---|
| WO 94/12407 | 6/1994 | WIPO | 85/672 |

OTHER PUBLICATIONS

Keyes–Fiber Company, Blueprints, 1979.

Henry Molded Products, Blueprint 12" Stakker, Apr. 6, 1990.

Prior Art Roll Support manufactured and sold by Fiber Packaging Corp., 1983.

Second Prior Art Roll Support manufactured and sold by Fiber Packaging Corp., of Jasper, TX in 1983.

Stakker Roll Support—manufactured and sold by Henry Molded Products.

Prior Art Fluorescent Light Tube Support, admitted prior art.

*Primary Examiner*—S. Thomas Hughes
*Assistant Examiner*—Jermie E. Cozart
*Attorney, Agent, or Firm*—Andrus, Sceales, Starke & Sawall

[57] ABSTRACT

A structure is provided for supporting and spacing rolls of web material. The structure includes an elongated member with first and second opposed surfaces. The first surface has a plurality of spaced, semi-cylindrical indentations therein for receiving the rolls of webbed material. A recess is located in each side portion of each semi-cylindrical indentation so as to form corresponding convex protrusions on the second, opposed surfaces. Bridging is placed along the second surface between the convex protrusion formed by a recess and a first semi-cylindrical indentation and the convex protrusion formed by the recess in a second, adjacent semi-cylindrical indentation.

22 Claims, 3 Drawing Sheets

FIG. 6
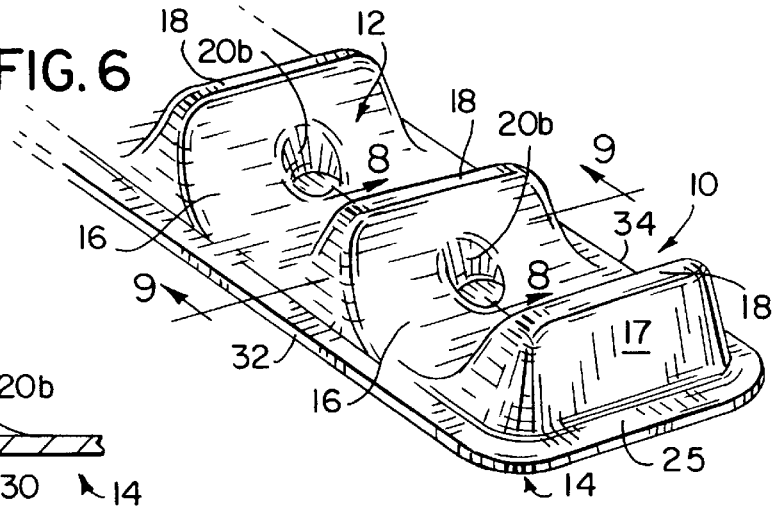
FIG. 8
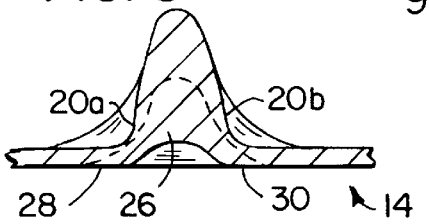
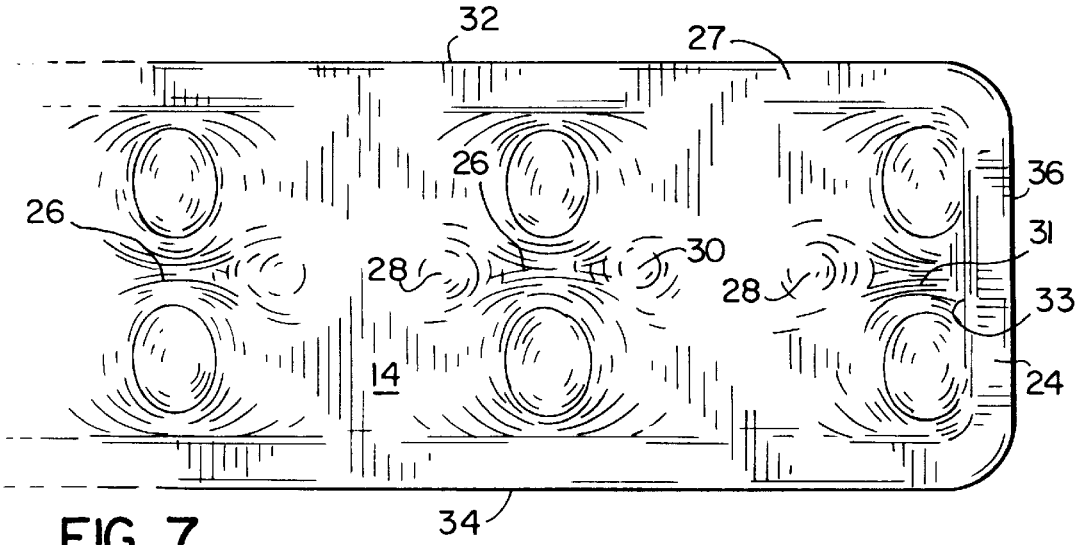
FIG. 7
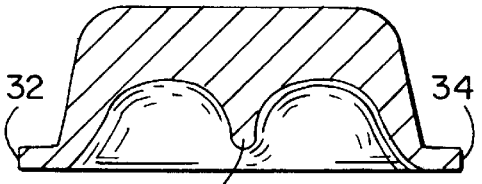
FIG. 9
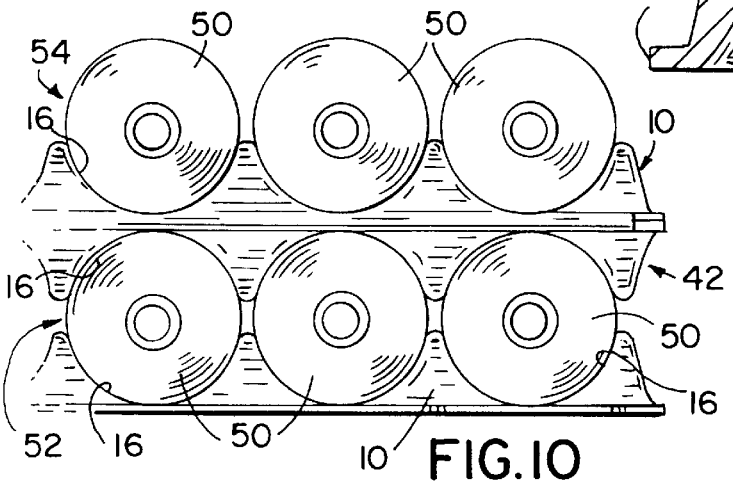
FIG. 10

MOLDED ROLL SUPPORT AND SPACING MEMBER HAVING REINFORCING BRIDGES

BACKGROUND AND SUMMARY OF THE INVENTION

This invention relates to packaging elements, and in particular, to a structure for supporting and spacing rolls of web material during shipment and storage.

Web materials are commonly stored and transported in rolls because the rolls are compact and facilitate the mounting of the material to automatic web handling equipment. While possessing numerous advantages, the rolls of web material exhibit certain disadvantages, particularly in the storage and transport of the material. For example, rolls have a propensity for movement if laid on their side, and tend to tip if stood on their ends. As a result, it is difficult to package the rolls for bulk shipment on a pallet or other shipping equipment.

The problem of shipping rolls of web material is particularly acute with relatively brittle materials such as cellophane, which require a high degree of protection during shipment. The failure to properly protect these materials may result in the web becoming torn on the edge of the roll or becoming nicked during transport and handling. Should this occur, the web will tear when tension is applied during subsequent processing and use of the material. End nicks are particularly acute since they tend to be radial in occurrence, causing repeated tearing along the length of the web and often rendering the whole roll unusable. Further, if the rolls become crushed during shipment, the resulting out of round condition may create difficulty in mating the core of the roll with the automatic web unwinding machine.

In order to alleviate the foregoing problems, various types of supporting and spacing members have been developed with varying degree of success. A highly successful supporting and spacing member is disclosed in Bell, U.S. Pat. No. 4,195,732, assigned to the assignee of the present invention, Great Northern Corporation, and incorporated herein by reference. The Bell '732 patent discloses a member for protectively supporting and spacing a plurality of rolls of web material such as cellophane, in a multi-layered stack. The members are comprised of an elongated bar having a plurality of spaced indentations along at least one surface of the bar for receiving the rolls of the stack therein. The bar is formed with sufficient flexibility to permit limited, relative movement among the rolls of the stack. This provides a high degree of protection to the rolls. At the same time, the bar has sufficient strength to prevent crushing of the stack. The bar may be formed of expanded polystyrene foam and may be formed with edging at the sides of the indentations in order to protect the ends of the rolls.

While supporting and spacing members constructed from expanded polystyrene have been highly successful, these types of supporting and spacing members have been perceived by some to be environmentally unfriendly. As is known, expanded polystyrene is not as readily recyclable as some packaging products like corrugated containers and inner packing, or aluminum cans, and therefore has sometimes been view unfavorably. Further, some insurance companies require special storage requirements for the warehousing of expanded polystyrene foam due to fire related concerns. While such concerns may not be justified, users of expanded polystyrene supporting and spacing members have sought alternative products.

To address the environmental concerns, supporting and spacing members formed from molded pulp have been developed. However, these molded pulp supporting and spacing members are often times inferior due to insufficient strength to adequately support the rolls of web material. Further, due to the substantial flexibility of products formed from molded pulp, molded pulp supporting and spacing members tend to be too flexible, thereby compromising the amount of protection for the web material.

In order to optimize the strength and flexibility of molded pulp supporting and spacing members, recesses are often times placed in the side portions of the semi-cylindrical indentations which receive the rolls of web material.

These recesses or depressions in the semi-cylindrical indentations provide greater flexural cushioning by the members when clamped to the rolls of web material, just as in the supporting and spacing members constructed from expanded polystyrene. However, due to the flexibility of products formed from molded pulp, often times molded pulp supporting and spacing members are still too flexible for use in connection with rolls of web material.

Therefore, it is a primary object and feature of the present invention to provide a molded pulp supporting and spacing member which optimizes the strength and flexibility characteristics of the member in order to protect rolls of web material during shipment.

It is a further object and feature of the present invention to provide a supporting and spacing member which is simple to mold, and is inexpensive to manufacture.

It is a still further object and feature of the present invention to provide a supporting and spacing member which is readily recyclable and hence, environmentally friendly.

In accordance with the present invention, a structure is provided for supporting and spacing of rolls of web material. The structure comprises an elongated member with first and second opposed surfaces. The first surface has a plurality of spaced, semi-cylindrical indentations therein for receiving rolls of web material. The second surface includes a generally planar outer edge. A recess is located on the side portion of each semi-cylindrical indentation and bridging is positioned along the second surface between the recess in a first semi-cylindrical indentation and the recess in a second, adjacent semi-cylindrical indentation in order to optimize the strength and flexibility of the structure. In the preferred embodiment, the elongated member is generally rectangular and is defined by first and second sides, and first and second ends.

The structure may also include a second, generally rectangular elongated member defined by first and second sides, and first and second ends, wherein the first side of the first elongated member is interconnected to the first side of the second elongated member. The second elongated member includes first and second opposed surfaces. The first surface has a plurality of spaced, semi-cylindrical indentations therein for receiving rolls of web material. The second surface of the elongated member includes a generally planar outer edge. The second elongated member further includes a recess located in the side portion of each semi-cylindrical indentation and bridging along the second surface of the second elongated member between the recess in a first semi-cylindrical indentation and the recess in a second adjacent semi-cylindrical indentation.

The first and second elongated members may be interconnected by a hinge. The hinge allows the first and second elongated members to pivot with respect to each other between a first position wherein a portion of each second surface lies in a common plane, and a second position wherein the outer edge of the second surface of the first elongated member engages the outer edge of the second surface of the second elongated member. The first and second elongated members and the hinge are integrally molded from a molded pulp material.

BRIEF DESCRIPTION OF THE PREFERRED EMBODIMENT

The drawings furnished herewith illustrate a preferred construction of the present invention in which the above advantages and features are clearly disclosed as well as others which will be readily understood from the following description of the illustrated embodiment.

In the drawings:

FIG. 6 is an isometric view showing a portion of a second embodiment of the supporting and spacing member of the present invention;

FIG. 7 is a bottom plan view showing a portion of the supporting and spacing member of FIG. 6;

FIG. 8 is a cross-sectional view of the supporting and spacing member of FIG. 6 taken along line 8—8;

FIG. 9 is a cross-sectional view of the supporting and spacing member of FIG. 6 taken along 9—9; and FIG. 10 is a side elevational view of a multi-layered stack of rolls formed with the supporting and spacing members of the present invention.

DESCRIPTION OF THE ILLUSTRATED EMBODIMENT

Figures 1, 5:
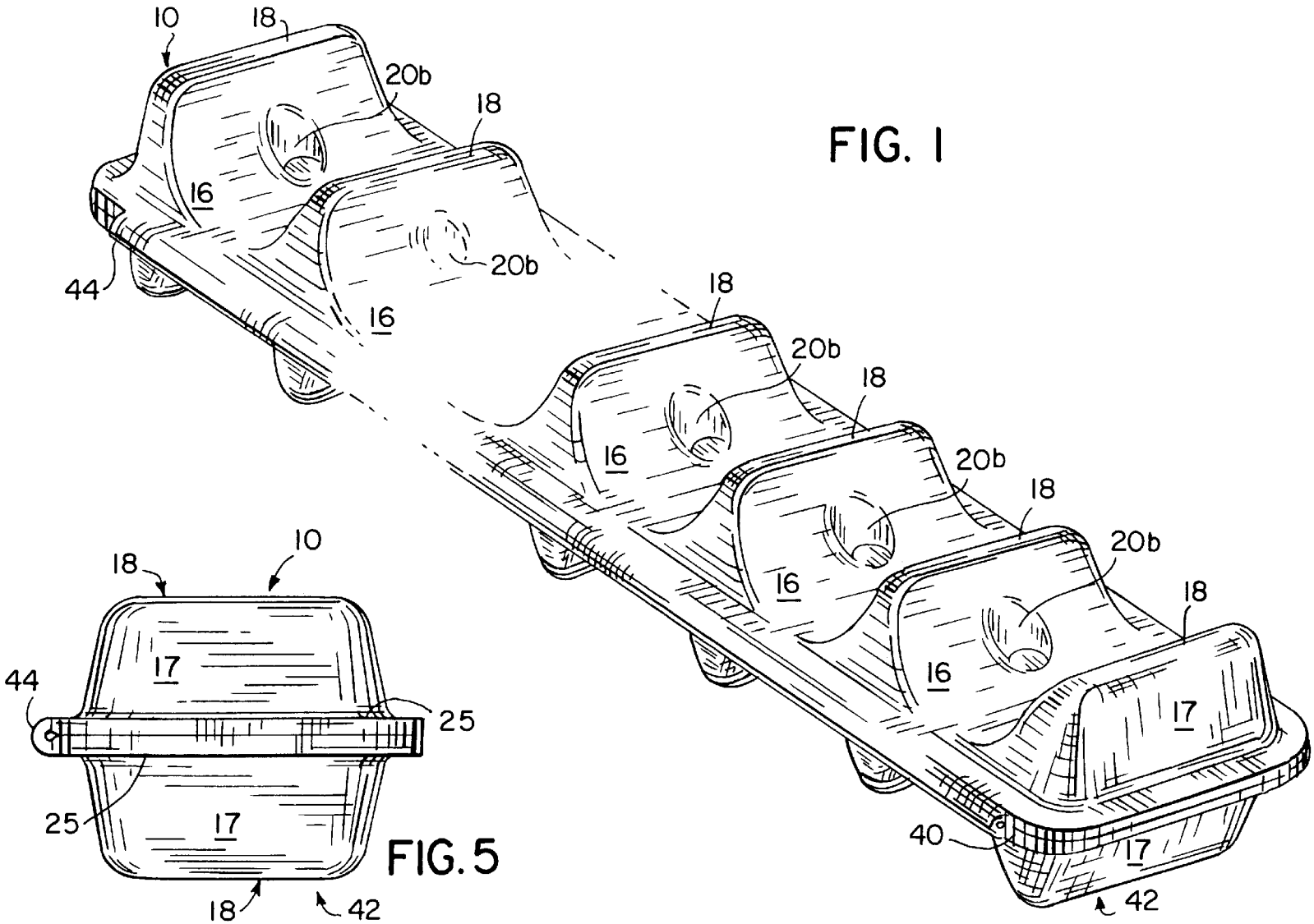
FIG. 1 is an isometric view of a supporting and spacing member in accordance with the present invention.
FIG. 5 is an end view of the supporting and spacing member of FIG. 1.

Referring to FIG. 6, the supporting and spacing member of the present invention is generally designated by the reference numeral 10. Supporting and spacing member 10 is designed to support and space a plurality of rolls, as hereinafter described. Supporting and spacing member 10 extends along a longitudinal axis and includes first 12 and second 14 opposed surfaces.

Figures 2, 3, 4:
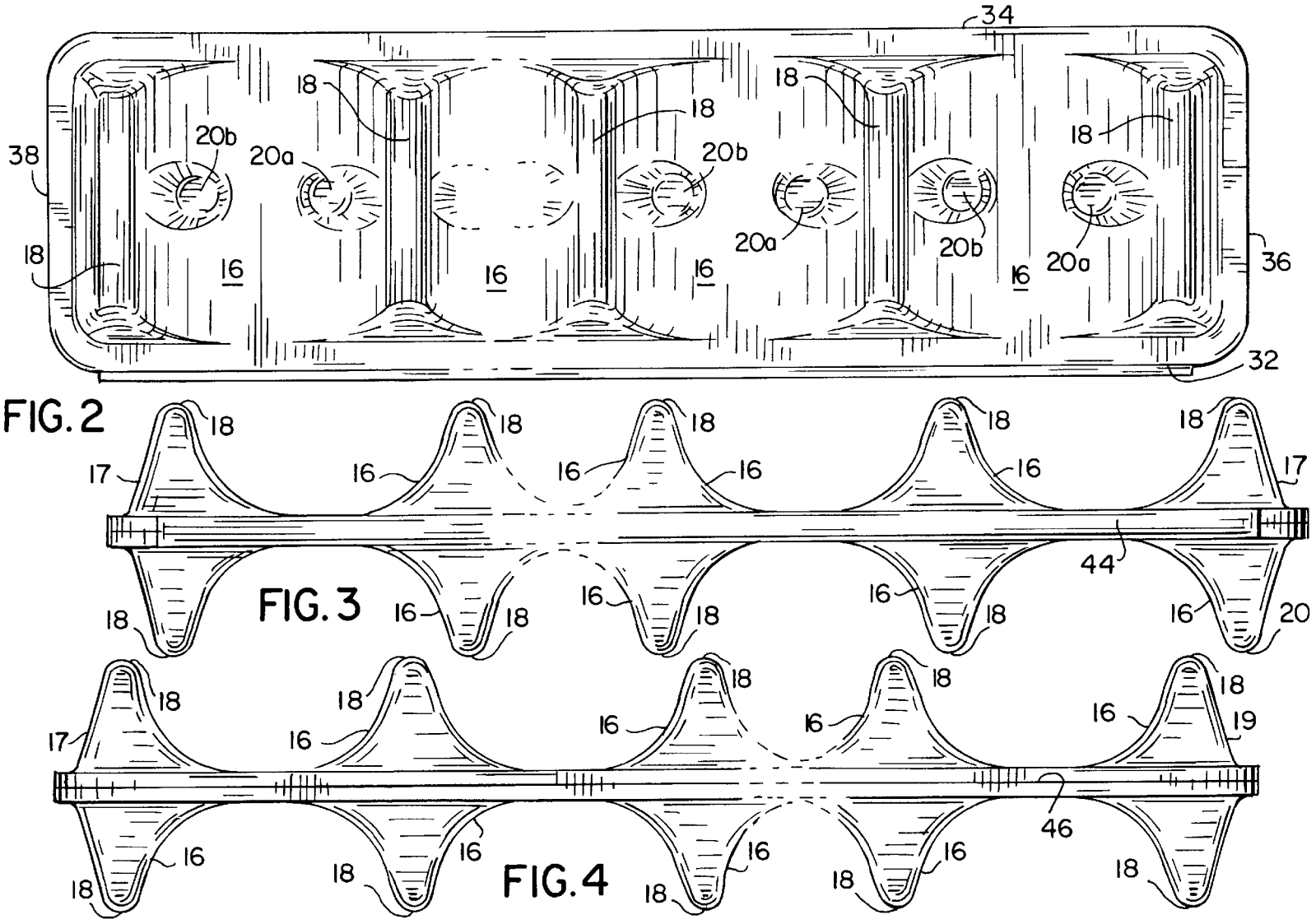
FIG. 2 is a top plan view of the supporting and spacing member of FIG. 1.
FIG. 3 is a side elevational view taken from the first side of the supporting and spacing member of FIG. 1.
FIG. 4 is a side elevational view taken from a second opposite side of the supporting and spacing member of FIG. 1.

The first surface 12 includes a plurality of spaced, semi-cylindrical indentations 16 which are separated by lands 18 and which are positioned between first and second generally vertical end walls 17 and 19, FIGS. 3–4. It is contemplated that the radius of each of the semi-cylindrical indentations 16 be greater than the depth of the indentation. By insuring that the radius of each semi-cylindrical indentation 16 is greater in depth of the corresponding indentation, the supporting and spacing members 10 do not engage each other, FIG. 10, when used to form a multi-layer stack, as hereinafter described.

Recesses 20*a* and 20*b* are provided in a corresponding side portions of each semi-cylindrical indentation 16. As best seen in FIGS. 7–8, each recess 20*a* and 20*b* in the first surface 12 of supporting and spacing member 10 forms a corresponding convex protrusion 28 and 30, respectively, on the second surface 14 of the supporting and spacing members. It is contemplated that the apex of each protrusion 28 and 30 on the second surface 14 of supporting and spacing member 10 lie in a generally common plane.

Referring to FIGS. 6 and 7, the supporting and spacing member 10 includes a generally flat border 24 which extends about the outer periphery thereof. Border 24 includes a generally flat upper face 25 and a second, opposed, generally flat lower face 27. As best seen in FIG. 8, the apex of each convex protrusion 28 and 30 and the lower face 27 of border 24 lie generally in a common plane.

The second surface 14 of supporting and spacer member 10 further includes a plurality of bridging elements 26. Each bridging element 26 which interconnects a convex protrusion 28 formed by a recess 20*a* in a first semi-cylindrical indentation with a convex protrusion 30 formed by a recess 20*b* in an adjacent semi-cylindrical indentation 16. An end bridging element 31 extends along second surface 14 of supporting and spacing member 10 and interconnects the inner surface 33 of first vertical end wall 17 with convex protrusion 28 which is formed by a recess 20*a* in the adjacent semi cylindrical indentation 16. Similarly, a second end bridging element extends along the second surface 14 of supporting and spacing member 10 in order to interconnect second vertical end wall 19 and convex protrusion 30 formed by a recess 20*b* in the semi-cylindrical indentation 16 adjacent thereto.

In the preferred embodiment, supporting spacing member 10 is generally rectangular in shape and border 24 is defined by first and second parallely extending edges 32 and 34, respectively, and first and second parallely extending ends 36 and 38, respectively. It is contemplated that the first edge 32 of supporting and spacing member 10 may be is interconnected to the first edge 40 of a second supporting and spacing member 42 by a hinge element 44. First and second supporting and spacing members 10 and 42 are identical, and as such it is intended that the description of the supporting and spacing member 10 in detail be understood to describe the second, supporting and spacing member 42, with common reference characters being used.

As best seen in FIGS. 1–5, hinge element 44 allows first and second supporting and spacing members 10 and 42, respectively to be pivoted with respect to each other between a first position wherein the lower faces 27 of each supporting and spacing member 10 and 42 respectively lie in a common plane, and a second position wherein the lower face 27 of border 24 of each supporting and spacing member 10 and 42, respectively, abut each other so as to form an intermediate supporting and spacing member 46.

Referring to FIG. 10, in operation, one or more supporting and spacing members 10 are positioned on a supporting surface such as a pallet or the like, such that semi-cylindrical indentations 16 extend upwardly for receiving rolls 50 of web material therein. The rolls are placed in the indentations 16 of supporting and spacing member 10 to form a lowermost layer 52.

Intermediate supporting and spacing member 46 having semi-cylindrical indentations 16 on both sides is then positioned on top of the rolls 50 of web material such that the downwardly facing semi-cylindrical indentation 16 of second supporting and spacing member 42 receive corresponding rolls 50 therein. Additional semi-cylindrical rolls 50 are then placed in the upwardly facing indentations 16 of supporting and spacing members 10 to form a second layer of rolls 54. The method is repeated until a stack having a predetermined number of layers is formed. Thereafter, the stack may be fastened to its supporting structure by strapping, shrink wrap or the like.

Various modes of carrying out the invention are contemplated as being within the scope of the following claims particularly pointing out and distinctly claiming the subject matter which is regarded as the invention.

I claim:

1. A structure for supporting and spacing rolls of web material, comprising:

an elongated member with first and second opposed surfaces, the first surface having a plurality of spaced, semi-cylindrical indentations therein for receiving rolls of web material, the second surface including an outer edge;

a recess located in a side portion of each semi-cylindrical indentation; and bridging along the second surface between the recess in a first semi-cylindrical indentation and the recess in a second, adjacent semi-cylindrical indentation.

2. The structure of claim 1 wherein the elongated member is generally rectangular and is defined by first and second sides, and first and second ends.

3. The structure of claim 2 further comprising a second, generally rectangular elongated member defined by first and second sides, and first and second ends, wherein the first side of the first elongated member is interconnected to the first side of the second elongated member.

4. The structure of claim 3 wherein the second elongated member includes first and second opposed surfaces, the first surface of the second elongated member having a plurality of spaced semi-cylindrical indentations therein for receiving rolls of web material, the second surface of the second elongated member including an outer edge.

5. The structure of claim 4 wherein the second elongated member includes a recess located in a side portion of each semi-cylindrical indentation.

6. The structure of claim 5 wherein the second elongated member includes bridging along the second surface between the recess in a first semi-cylindrical indentation and the recess in a second, adjacent semi-cylindrical indentation.

7. The structure of claim 4 wherein the first and second elongated members are interconnected by a hinge such that the first and second elongated members are pivotable with respect to each other between a first position wherein a portion of each second surface lies in a common plane, and a second position wherein the outer edge of the second surface of the first elongated member engages the outer edge of the second surface of the second elongated member.

8. The structure of claim 7 wherein the first and second elongated members and the hinge are integrally molded.

9. The structure of claim 1 wherein the first elongated member is molded from a molded pulp material.

10. A structure for protectively supporting and spacing rolls in a multilayer stack, comprising:

an elongated member having first and second opposed surfaces:

a plurality of spaced, semi-cylindrical indentations formed in the first surface of the elongated member for receiving a respective roll therein;

a recess located in a side portion of each semi-cylindrical indentation, each recess forming a convex protrusion on the second surface of the elongated member; and a support element interconnecting the convex protrusion formed by the recess in a first semi-cylindrical indentation and the convex protrusion formed by the recess in a second, adjacent semi-cylindrical indentation.

11. The structure of claim 10 wherein the portions of the first surface disposed between the semi-cylindrical indentations constitute lands.

12. The structure of claim 10 wherein the semi-cylindrical indentations include a bottom portion free of recesses.

13. The structure of claim 10 wherein the elongated member is defined by first and second sides and first and second ends.

14. The structure of claim 13 wherein a first of said semi-cylindrical indentations includes a second recess formed in a second side portion thereof, the second recess forming a corresponding second convex protrusion on the second surface of the elongated member.

15. The structure of claim 14 further comprising a second support element interconnecting the second convex protrusion formed by the second recess in the first semi-cylindrical indentation and the first end of the elongated member.

16. The structure of claim 13 further comprising a second, generally rectangular elongated member defined by first and second sides, and first and second ends, wherein the first side of the first elongated member is interconnected to the first side of the second elongated member.

17. The structure of claim 16 wherein the second elongated member includes first and second opposed surfaces, the first surface of said second elongated member having a plurality of spaced, semi-cylindrical indentations therein for receiving a respective one of said rolls, the second surface of the second elongated member including a generally planar outer edge.

18. The structure of claim 17 wherein the second elongated member includes a recess located in a side portion of each semi-cylindrical indentation.

19. The structure of claim 18 wherein the second elongated member includes a support element along the second surface between the recess in a first semi-cylindrical indentation and the recess in a second, adjacent semi-cylindrical indentation.

20. The structure of claim 17 wherein the first and second elongated members are interconnected by a hinge such that the first and second elongated members are pivotable with respect to each other between a first position wherein a portion of each second surface lies in a common plane, and a second position wherein the second surface of the first elongated member partially engages the second surface of the second elongated member.

21. The structure of claim 20 wherein the first and second elongated members and the hinge are integrally molded.

22. The structure of claim 10 wherein the first elongated member is molded from a molded pulp material.

* * * * *